US009315886B1

(12) United States Patent
Sethian et al.

(10) Patent No.: US 9,315,886 B1
(45) Date of Patent: Apr. 19, 2016

(54) DESENSITIZATION OF ALUMINUM ALLOYS USING PULSED ELECTRON BEAMS

(71) Applicant: The United States of America as represented by the Secretary of the Navy, Washington, DC (US)

(72) Inventors: John D. Sethian, Burke, VA (US); Matthew C. Myers, Beltsville, MD (US); Mathew Wolford, Woodbridge, VA (US); Frank Hegeler, Vienna, VA (US); Ronald L. Holtz, Lorton, VA (US); Derek Horton, Alexandria, VA (US); Alexis C. Lewis, Alexandria, VA (US); Kathryn J. Wahl, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/614,686

(22) Filed: Feb. 5, 2015

Related U.S. Application Data

(60) Provisional application No. 62/017,856, filed on Jun. 27, 2014.

(51) Int. Cl.

| | |
|---|---|
| ***C22F 1/047*** | (2006.01) |
| ***C22C 21/08*** | (2006.01) |
| ***C21D 1/34*** | (2006.01) |

(52) U.S. Cl.
CPC . *C22F 1/047* (2013.01); *C21D 1/34* (2013.01); *C22C 21/08* (2013.01)

(58) Field of Classification Search
CPC ..... C22F 1/047; C22C 21/08; C21D 1/34
See application file for complete search history.

(56) References Cited

U.S. PATENT DOCUMENTS

| | | | | |
|---|---|---|---|---|
| 4,382,186 | A * | 5/1983 | Denholm et al. | 250/492.2 |
| 5,833,918 | A * | 11/1998 | Matossian et al. | 266/251 |
| 2003/0019850 | A1* | 1/2003 | Kensuke | A61C 13/0003 219/121.61 |
| 2014/0324186 | A1* | 10/2014 | Blacklock | A61F 2/30771 623/23.6 |

OTHER PUBLICATIONS

R. Schwarting, G. Ebel, and T.J. Dorsch, "Manufacturing techniques and process challenged with CG47 class ship aluminum superstructures modernization and repairs," Fleet Maintenance & Modernization Symposium 2001: Assessing Current & Future Maintenance Strategies, San Diego, 2011.

(Continued)

*Primary Examiner* — Roy King
*Assistant Examiner* — Janelle Morillo
(74) *Attorney, Agent, or Firm* — US Naval Research Laboratory; Joslyn Barritt

(57) ABSTRACT

A method for desensitizing an aluminum alloy is presented. A desired location on the surface of an aluminum alloy sample is exposed to a controlled pulsed electron beam. The pulsed electron beam heats a shallow layer of the metal alloy having a desired depth at the desired location on the surface of the sample to a temperature between a solvus temperature and an annealing temperature of the metal alloy to controllably reduce a degree of sensitization of the metal alloy sample at the desired location, an extent of a reduction in the degree of sensitization being controllable by varying at least one of a voltage, a current density, a pulse duration, a pulse frequency and a number of pulses of the electron beam.

16 Claims, 12 Drawing Sheets

(56) References Cited

OTHER PUBLICATIONS

L. Kramer, M. Phillippi, W.T. Tack, and C. Wong, "Locally Reversing Sensitization in 5xxx Aluminum Plate," Journal of Materials Engineering and Performance (2012) 21:1025-1029.

Y. Zuo and Y.A. Chang, "Thermodynamic Calculation of the Al—Mg Phase Diagram," CALPHAD, vol. 17, No. 2, pp. 161-174 (1993).

Y.K. Yang and T.R. Allen, "Determination of the beta Solvus Temperature of the Aluminum Alloys 5083," Metallurgical and MaterialsTransactions A—Physical Metallurgy and Materials Science, vol. 44A, Issue 11, pp. 5226-5233 (2013).

Heat Treating of Aluminum Alloys, American Society for Metals Handbook, vol. 4, ASM International, Materials Park, Ohio, pp. 841-879 (1991).

A.P. Reynolds and J. Chrisfield, "Friction Stir Processing for Mitigation of Sensitization in 5XXX Series Aluminum Alloys," Corrosion, vol. 68, No. 10 (2012), pp. 913-921.

J.D. Sethian, M. Myers, I.D. Smith, V. Carboni, J. Kishi, D. Morton, J. Pearce, B. Bowen, L. Schlitt, O. Barr, and W. Webster, "Pulsed power for a rep-rate, electron beam pumped, KrF laser," IEEE Trans Plasma Sci., 28, 1333 (2000).

F. Hegeler, M.W. McGeoch, J.D. Sethian, H.D. Sanders, S.C. Glidden, and M.C. Myers, "A durable, gigawatt class solid state pulsed power system," IEEE Transactions on Dielectrics and Electrical Insulation, vol. 18, Issue 4, pp. 1205-1213, Aug. 2011.

J.A. Halbleib, R.P. Kensek, G.D. Valdez, S.M. Seltzer, and Martin J. Berger, "ITS: The Integrated TIGER Series of Electron/Photon Transport Codes—Version 3.0," IEEE Trans. Nucl. Sci, vol. 39, pp. 1025-1030, 1992.

J.D. Sethian, M.C. Myers, J.I. Giuliani, Jr., R. H. Lehmberg, P.C. Kepple, S.P. Obenschain, F. Hegeler, M. Friedman, M.F. Wolford, R.V. Smilgys, S.B. Swanekamp, D. Weidenheimer, D.Giorgi, D.R. Welch, D.V. Rose, and S. Searles, "Electron beam pumped krypton fluoride lasers for fusion energy," Proc. IEEE, 92, (2004) 1043-1056.

J. Buczynski, "Electrochemical analysis of etchants used to detect sensitization in marine-grade 5xxx aluminum—magnesium alloys," M.S. Thesis, University of Virginia (2012).

* cited by examiner

NAMLT= Nitric Acid Mass Loss Test
H116 Alloy
Sensitized for 30 minutes

Adapted from: L. Kramer, M. Phillippi, W. T. Tack & C. Wong, "Locally Reversing Sensitization in 5xxx Aluminum Plate," Journal of Materials Engineering and Performance, Published online 22 July, 2011.

5000 Aluminum Sample

As received

After aging/sensitization

After e-beam desensitization

DESENSITIZATION OF ALUMINUM ALLOYS USING PULSED ELECTRON BEAMS

CROSS-REFERENCE

This application is a Nonprovisional of, and claims the benefit of priority under 35 U.S.C. §119 based on, U.S. Provisional Patent Application No. 62/017,856 filed on Jun. 27, 2014, the entirety of which is hereby incorporated by reference into the present application.

TECHNICAL FIELD

The present invention relates to treatment of aluminum, particularly the 5000 series aluminum alloys used in Navy ships and other maritime vessels, to reduce its susceptibility to corrosion and other damage.

BACKGROUND

Aluminum-magnesium alloys are important technological alloys for marine applications. With magnesium concentrations of 3 to 6%, along with other alloying additions and appropriate thermomechanical processing, the alloys are high strength, light weight, resistant to seawater corrosion, and weldable. These characteristics make these alloys attractive for lightweight, high speed, fuel efficient ships, amphibious craft, and land vehicle armor.

These qualities make aluminum a particularly useful metal for marine vessels. An important class of aluminum alloys that are widely used in Navy and commercial ships are the 5000-series aluminum alloys, often referred to as "5000 aluminum." These alloys contain magnesium to enhance their strength, where the magnesium forms a solid solution having a magnesium concentration of between 3 and 6% in the aluminum bulk.

However, over time, and particularly under prolonged in-service exposure to high temperatures, the magnesium in these alloys migrates to the grain boundaries in the material, where, as can be seen in the optical metallography shown in FIG. 1, it can combine with the aluminum to form second phase "precipitates ("beta particles") with having an approximate stoichiometry of $Al_3Mg_2$ at the grain boundaries. This environmentally induced process, known as "sensitization," significantly reduces the material's intergranular corrosion resistance, and leads to stress corrosion cracking of the alloy.

The degree of sensitization ("DOS") is related to the density of beta particles present at the grain boundaries. A DOS near zero corresponds to a beta particle density of about 60% or less, while a DOS of 40 or more corresponds to a nearly 100% beta particle density at the grain boundaries. If the beta particle density on the grain boundaries exceeds about 60 to 65%, continuous networks of the particles may form, resulting in accelerated intergranular corrosion rates. It has been observed that if the DOS exceeds about 30, significant degradation of the corrosion fatigue and stress corrosion properties can occur, which rapidly gets worse with further increase of DOS.

Such sensitization affects a large class of Navy ships, including the DDG 963, CG, and FFG classes, which use 5000 series aluminum alloys in their deck plates and/or superstructures, as well potentially the Littoral Combat Ship (LCS), Joint High Speed Vessel (JHSV), and Joint Maritime Assault Connector (JMAC) that also will use this alloy of aluminum to achieve their performance. An example of sensitization-induced cracking on a Navy ship can be seen in FIG. 2, which shows a crack in the aluminum deckplate of a CG-47 Ticonderoga Class cruiser. The CG-47 class, which uses alloy 5456-H116 in their deck and superstructure plating, has experienced severe degradation from sensitization. As can be seen in FIG. 2, the crack is several millimeters wide and extends all the way through the 5-millimeter-thick deck plate. See R. Schwarting, G. Ebel, and T. J. Dorsch, "Manufacturing techniques and process challenged with CG47 class ship aluminum superstructures modernization and repairs," *Fleet Maintenance & Modernization Symposium* 2001*: Assessing Current & Future Maintenance Strategies,* San Diego, 2011. If such cracking occurs, the only permanent remedy is to replace the parts, which is an expensive activity and can only be done with the ship out of service. Consequently, it is highly desirable to prevent cracking before it occurs.

Studies show that the sensitization of aluminum can be reversed by heating the aluminum to a temperature which both causes the beta phase particles to dissociate and causes the magnesium to dissolve back into the aluminum bulk. This process is known as "desensitization." See L. Kramer, M. Phillippi, W. T. Tack, and C. Wong, "Locally Reversing Sensitization in 5xxx Aluminum Plate," *Journal of Materials Engineering and Performance* (2012) 21:1025-1029.

As illustrated in the plots shown in FIG. 3, such desensitization occurs only over a limited temperature range. At temperatures below about 230° C., the aluminum remains sensitized, while at temperatures above about 345° C., aluminum will begin to anneal and soften (i.e. lose strength). Consequently, the temperature of the aluminum alloy during desensitization must be kept between about 230° C. and about 345° C. for sensitization to occur without loss of strength in the metal.

Dissolving the beta phase requires that the temperature be raised above the solvus temperature of the alloy, which depends upon exact alloy composition and temper condition. Generally, the solvus temperature for the 5000 series alloys that experience sensitization will be higher than that for a pure binary aluminum-magnesium alloy, see Y. Zuo and Y. A. Chang, "Thermodynamic Calculation of the Al—Mg Phase Diagram," *CALPHAD*, Vol. 17, No. 2, pp. 161-174 (1993), and will increase with additional concentrations of other alloying elements. For example, a pure binary alloy of aluminum and magnesium at 4.5 percent magnesium (i.e., an alloy having the same magnesium concentration as alloy 5083) has an estimated solvus temperature of 230° C., while commercial alloy 5083, which has additional constituents, has an experimentally measured solvus value of 290° C. See Y. K. Yang and T. R. Allen, "Determination of the beta Solvus Temperature of the Aluminum Alloys 5083," *Metallurgical and Materials Transactions A—Physical Metallurgy and Materials Science*, Vol. 44A, Issue 11, pp. 5226-5233 (2013). Commercial alloy 5456, which has a nominal magnesium concentration of 5.5 percent, should have a solvus temperature above the binary alloy value of about 260° C.; although the actual solvus has not been experimentally measured.

In addition, as noted above, desensitization should not be performed at temperatures high enough to anneal the alloy. Although such high temperatures will desensitize the alloy, they also will considerably soften the alloy, reducing its strength. Standard reference sources list 345° C. as the typical annealing temperature for 5000 series alloys including 5083 and 5456. See, e.g., *Heat Treating of Aluminum Alloys*, American Society for Metals Handbook, Vol. 4, ASM International, Materials Park, Ohio, pp. 841-879 (1991). Thus, the temperature needed to achieve desensitization without softening in marine service alloys will generally be within the broad range between 230° C. and 345° C., with specific, narrower temperature ranges for alloy compositions being determined empirically in each case.

Various methods to heat the aluminum to a temperature sufficient for desensitization while keeping the temperature within this critical range have been proposed.

In one method, a flexible ceramic pad heater is used to apply heat to the surface of the sensitized aluminum. See L. Kramer, et al., supra. In another method, friction-stir processing is used to heat and thereby desensitize the metal. See, e.g., A. P. Reynolds and J. Chrisfield, "Friction Stir Processing for Mitigation of Sensitization in 5XXX Series Aluminum Alloys," *Corrosion*, Vol. 68, No. 10 (2012), pp. 913-921.

However, there are significant problems with these approaches. Both approaches require intimate contact with the aluminum, so their efficiency can be compromised by the presence of surface irregularities such as weld seams. In addition, the pad heater is a slow process and locally heats the entire structure. Large-scale heating of the structure is undesirable because it potentially increases sensitization levels in areas around the zone being treated, it introduces residual stresses in weld connections to the underlying framing which can result in local fatigue cracking, and it exposes the interior of the ship, including sensitive electronics and equipment, to potentially damaging temperatures. Finally, if it heats the aluminum above the anneal temperature of 345° C. as shown in FIG. 3, it compromises the strength of the material. The friction-stir process is somewhat faster than pad heating and has the potential advantage of preferentially heating a shallower layer, but it is still impractical because the deck plating on a ship cannot support the considerable mechanical forces required for such a process.

Neither these nor any other approach has so far been deployed in the fleet, and the sensitization and the resulting susceptibility of 5000 aluminum to corrosion and other damage, remains a significant issue.

SUMMARY

This summary is intended to introduce, in simplified form, a selection of concepts that are further described in the Detailed Description. This summary is not intended to identify key or essential features of the claimed subject matter, nor is it intended to be used as an aid in determining the scope of the claimed subject matter. Instead, it is merely presented as a brief overview of the subject matter described and claimed herein.

The present invention provides a method for desensitizing an aluminum alloy. In accordance with the present invention, a desired location on the surface of an aluminum alloy sample is exposed to a controlled pulsed electron beam. The pulsed electron beam heats a shallow layer of the metal alloy having a desired depth at the desired location on the surface of the sample to a temperature between the solvus temperature and an annealing temperature of the metal alloy to controllably reduce a degree of sensitization of the metal alloy sample at the desired location, an extent of a reduction in the degree of sensitization being controllable by varying at least one of a voltage, a current density, a pulse duration, a pulse frequency and a number of pulses of the electron beam.

DETAILED DESCRIPTION

The aspects and features of the present invention summarized above can be embodied in various forms. The following description shows, by way of illustration, combinations and configurations in which the aspects and features can be put into practice. It is understood that the described aspects, features, and/or embodiments are merely examples, and that one skilled in the art may utilize other aspects, features, and/or embodiments or make structural and functional modifications without departing from the scope of the present disclosure.

For example, the electron beam desensitization treatment of the present invention is described herein in the context of desensitization of an aluminum alloy, often referred to herein simply as "aluminum" or "alloy," and is of particular interest in connection with the 5000-series aluminum alloys commonly used for maritime applications such as deckplates for Navy ships.

Figure 1:
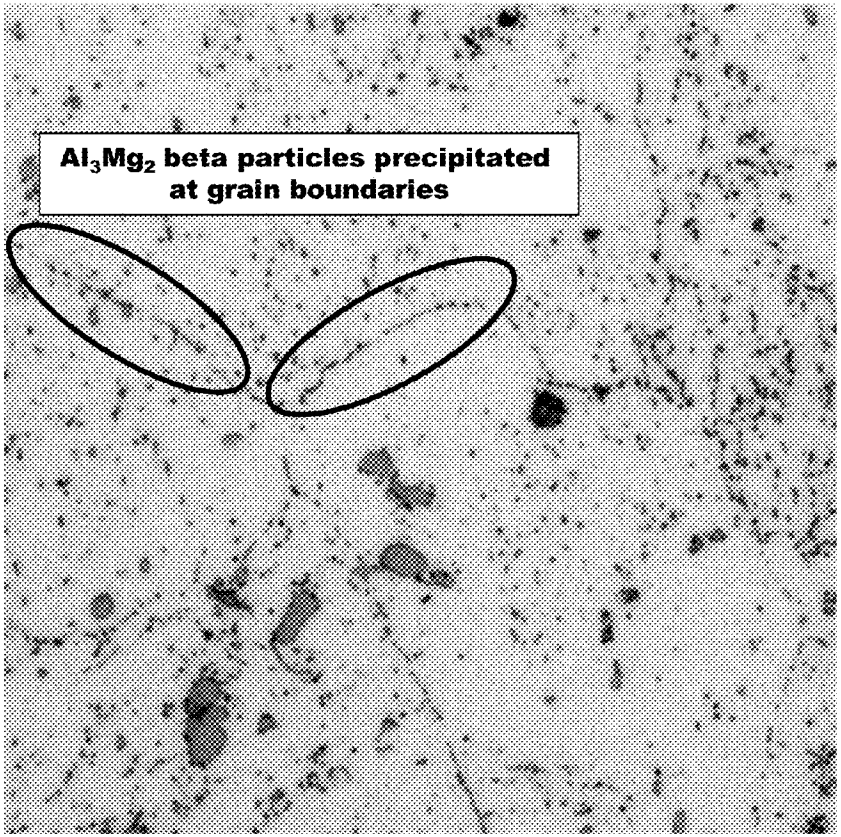
FIG. 1 is an optical metallographic image showing examples of the concentration of precipitated $Al_3Mg_2$ beta particles at the grain boundaries of a 5000 aluminum sample.
Figure 2:
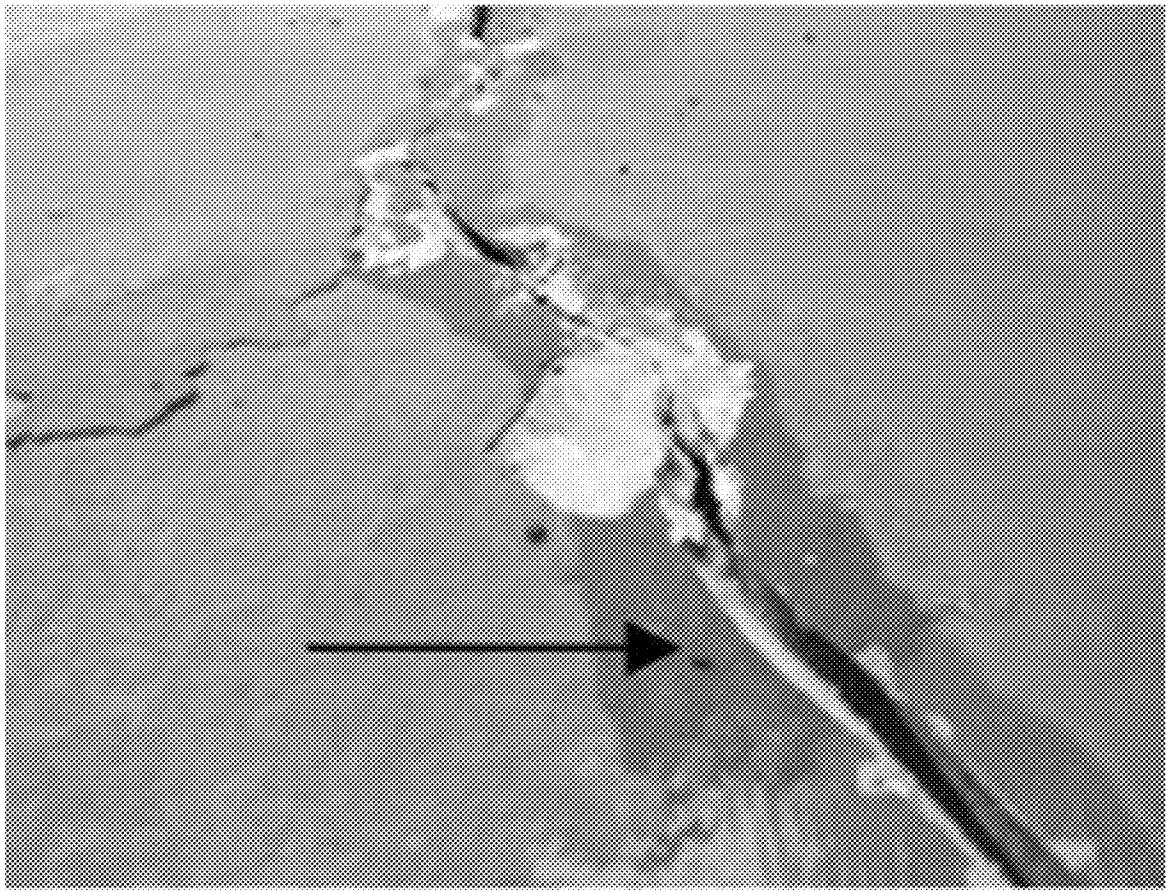
FIG. 2 is a photographic image depicting damage and cracking in the deckplate of a Navy vessel resulting from sensitization of the 5000 aluminum forming the deckplate.
Figure 3:
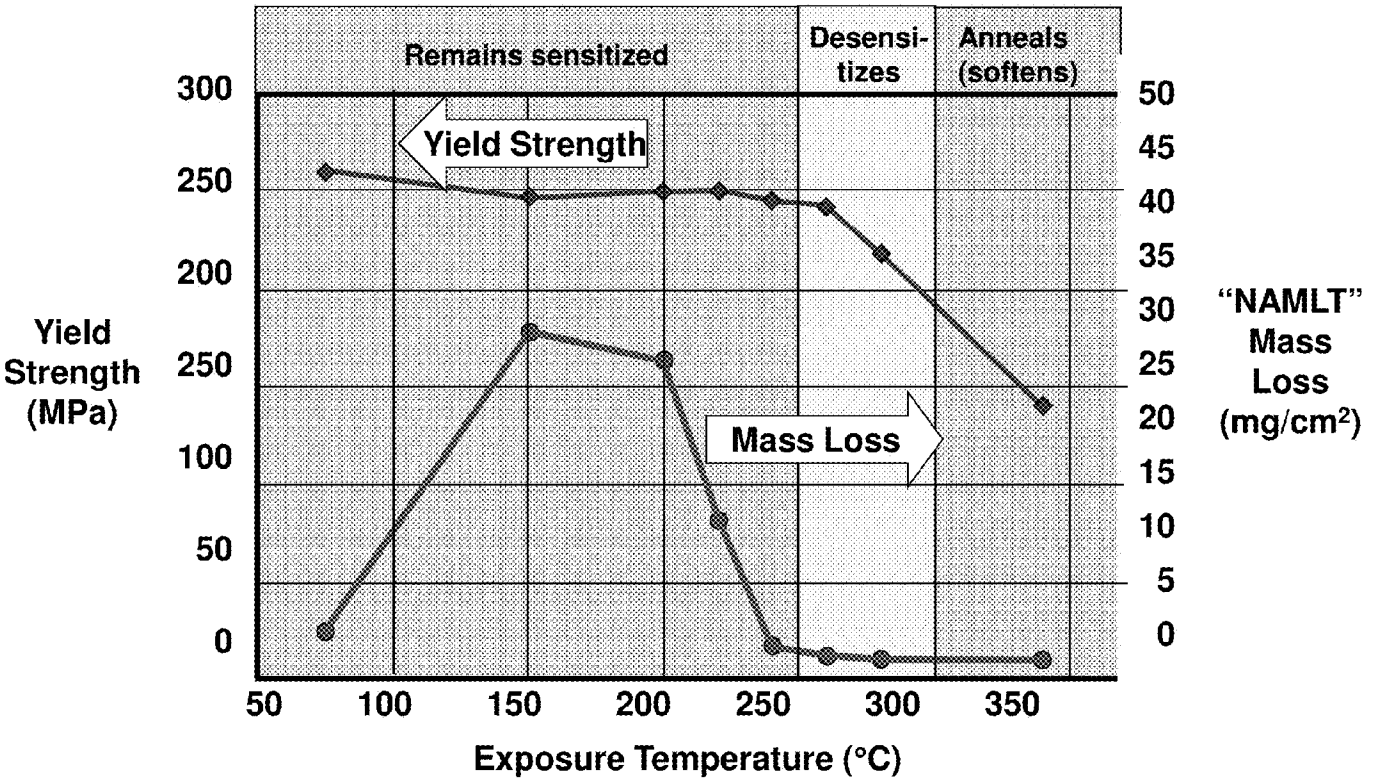
FIG. 3 is a plot illustrating that aluminum can be desensitized by exposure to temperatures between about 230 and 345° C., depending on the alloy.

As noted above, it has previously been discovered that sensitization of aluminum can be reversed by heating the aluminum to a point above its solvus temperature while being kept below the point at which it begins to anneal. See Kramer, supra. As illustrated by the plots in FIG. 3 described above, the aluminum thus must be heated to a temperature above about 230° C. (depending on the alloy) for desensitization to occur while being kept below a temperature of about 345° C. to prevent the aluminum from annealing. As described above, previously used methods for heating aluminum, particularly aluminum that has already been fabricated into, for example, a ship deck, are unsatisfactory because they either end up heating the bulk of the aluminum in order to treat undesirable sensitization that occurs only at the surface, or require equipment that, in order to be effective, must apply potentially damaging mechanical forces to the material.

The present invention overcomes the problems of the prior art method by using a pulsed high voltage, high current electron beam to provide the heat necessary to desensitize an aluminum alloy such as the 5000 series aluminum alloy used in Navy ships heat in a localized, depth-controlled manner.

Figure 4:
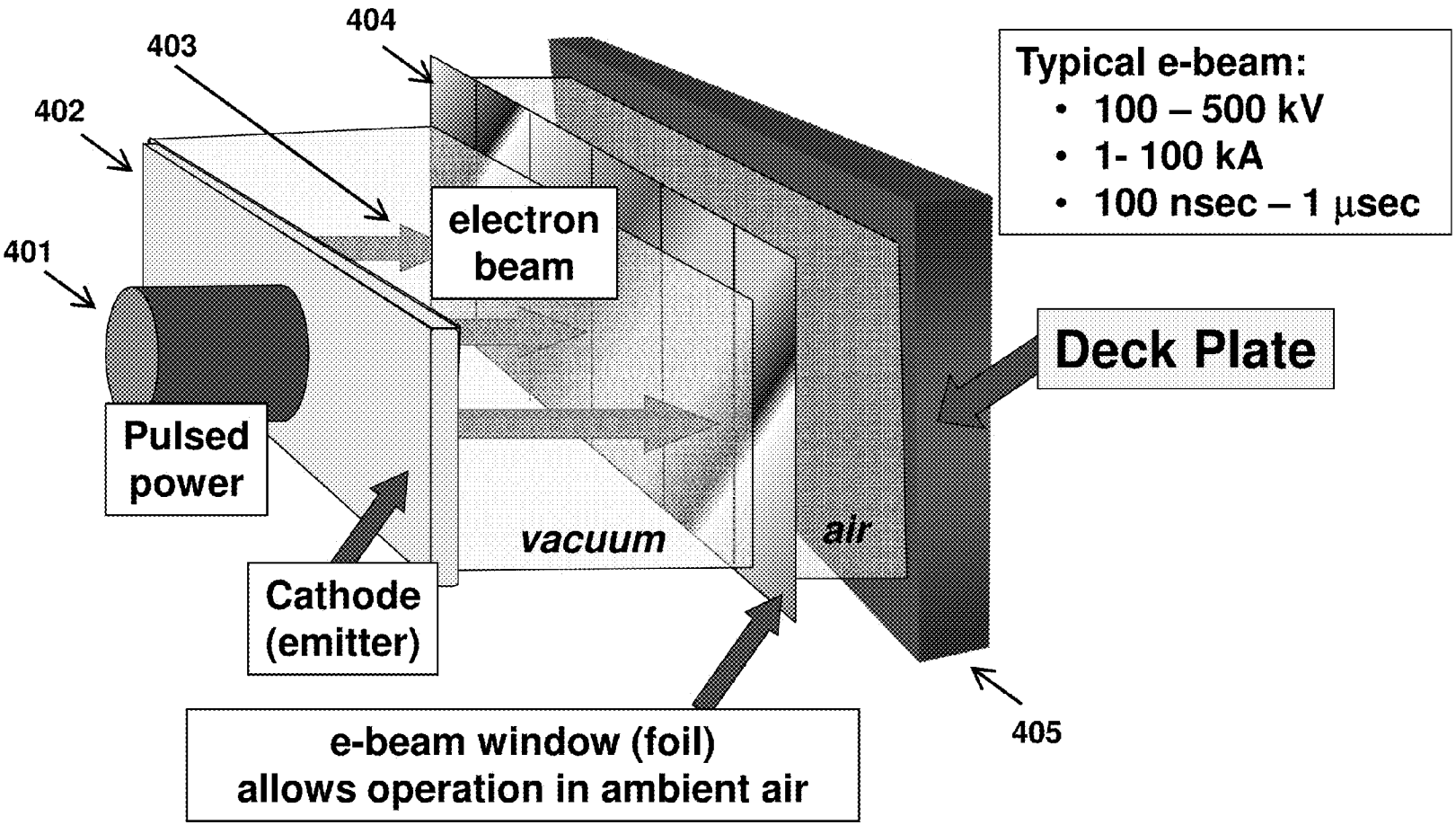
FIG. 4 is a block diagram illustrating aspects of an exemplary embodiment of an apparatus for desensitizing aluminum using pulsed high voltage, high current electron beams in accordance with the present invention.

Thus, as described in more detail below, in accordance with the present invention, environmentally induced corrosion susceptibility in an aluminum alloy can be reversed by applying a properly configured pulsed high voltage, high current electron beam to the alloy's surface. FIG. 4 is a block diagram illustrating aspects of an exemplary embodiment of an electron beam apparatus that can be used to desensitize aluminum alloys such as 5000 aluminum in accordance with the present invention.

Thus, as illustrated in FIG. 4, an aluminum sample such as deck plate 405 can be desensitized by applying a pulsed electron beam 403 generated by applying a current produced by pulsed power source 401 through a cathode 402, with target deck plate 405 absorbing the electron beam. In some embodiments, the apparatus can be configured so that electron beam travels from the cathode 402 to the target 405 in a vacuum (in which case the deckplate 405 is the anode), while in other embodiments, the apparatus can be configured so that the electron beam 403 travels through a foil window 404, (in which case the foil window 405 is the anode) which allows the beam to travel through, and the apparatus to operate in, the ambient air.

Any suitable pulsed power supply can be used, such as the repetitive pulsed power supply based on spark gap switches as used in the Electra repetitive pulsed electron beam facility at the Naval Research Laboratory (NRL). See J. D. Sethian, M. Myers, I. D. Smith, V. Carboni, J. Kishi, D. Morton, J. Pearce, B. Bowen, L. Schlitt, O. Barr, and W. Webster, "Pulsed power for a rep-rate, electron beam pumped, KrF laser," *IEEE Trans Plasma Sci.,* 28, 1333 (2000). In other embodiments, the power supply can be based on other systems such as the more advanced all solid-state system demonstrated by NRL. See F. Hegeler, M. W. McGeoch, J. D. Sethian, H. D. Sanders, S. C. Glidden, and M. C. Myers, "A durable, gigawatt class solid state pulsed power system," *IEEE Transactions on Dielectrics and Electrical Insulation*, Vol. 18, Issue 4, pp. 1205-1213, August 2011, both of which are hereby incorporated by reference into the present disclosure in their entirety.

A typical pulsed electron beam generated by an apparatus configured for use in the method of the present invention will have a voltage of about 100 to about 600 kV, a current of about 1 to about 100 kA, and a pulse duration of about 100 nsec to about 1 μsec. with the electron beam source having an ability to operate in bursts of 10 to 100 pulses at 0.1 to 5 pulses per second.

The electron beam can be controllably directed to specific areas on the surface of the aluminum, e.g., areas that have been identified as having an unacceptably high degree of sensitization. Thus, the present invention enables controlled, localized desensitization of specific areas on the aluminum surface without the need for unnecessarily treating large areas not suffering from the effects of sensitization.

In addition, a pulsed electron beam incident upon the surface of an aluminum sample deposits its energy only into a shallow layer, e.g., to a depth of 10 to 200 microns, depending on the energy of the electron beam. See J. A. Halbleib, R. P. Kensek, G. D. Valdez, S. M. Seltzer, and Martin J. Berger, "ITS: The Integrated TIGER Series of Electron/Photon Transport Codes—Version 3.0," *IEEE Trans. Nucl. Sci*, Vol. 39, pp. 1025-1030, 1992. Thus, any heating of the metal that results from this added energy will also occur only within this shallow layer at the surface, and will quickly attenuate at greater depths. Because desensitization of commercial 5000 series alloys requires temperatures between 230-345° C., depending on the alloy, desensitization will not occur at depths in the metal where the electron beam does not raise the temperature to a sufficient degree. In addition, using a pulsed beam allows the surface to cool slightly between pulses, limiting the heating of the metal caused by this added energy and allowing it to be controllably heated to a desired depth without excessively heating its interior or backside. In the case of an electron beam being used to desensitize an aluminum deckplate on a ship, this means that a shallow (10-200 μm) surface layer of the deckplate can be treated and desensitized while the bulk of the deckplate, which has a thickness of 5 mm to 8 mm (5000 to 8000 μm), and thus the interior of the ship, remain relatively cool. It also means that the bulk material properties (strength, yield), which can be compromised by heat, will remain unchanged. In some embodiments, the back side of the material (i.e., the side opposite the electron beam exposure) can be actively cooled by flowing air or a water cooled plate.

As described in more detail below, this depth within the metal at which desensitization occurs can be controlled by varying the power and/or the current of the applied electron beam.

FIGS. 5 through 9 further illustrate aspects of the way in which a pulsed electron beam can be used to reverse the sensitization of a metal such as 5000 aluminum in accordance with the present invention.

Figure 5:
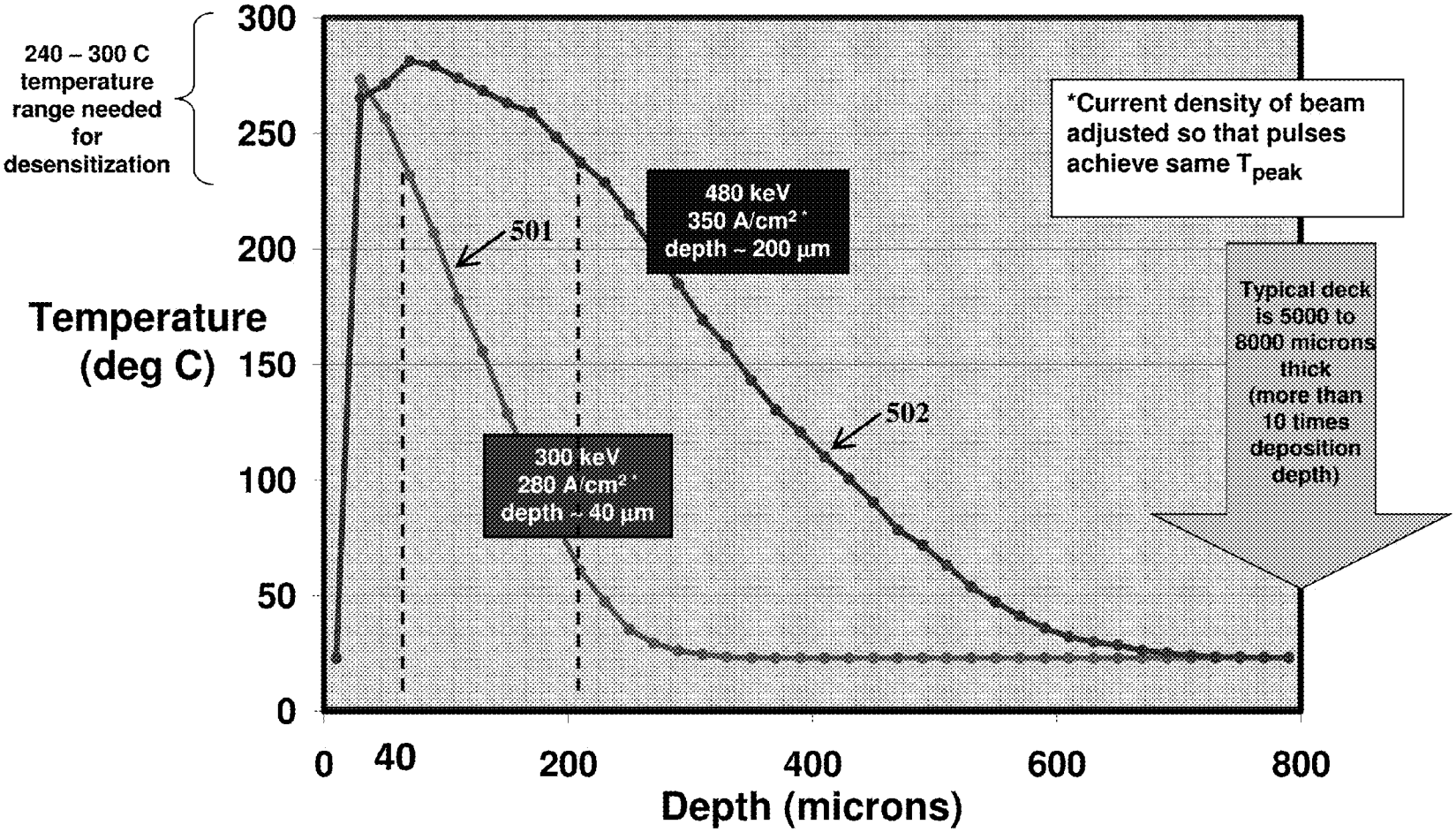
FIG. 5 contains plots illustrating that the depth of electron beam desensitization in accordance with the present invention can be controlled by varying parameters of the electron beam.

The plots shown in FIG. 5 illustrate how the depth of desensitization can be varied by adjusting the parameters of the electron beam. As noted above, desensitization requires the heating of the aluminum to a temperature between 230 and 345° C., depending on the alloy, while the electron beam heats, and therefore desensitizes, only a very shallow layer at the surface of the aluminum.

As shown in FIG. 5, plot 501, an electron beam having a voltage (energy) of 300 keV and a current density of 280 A/cm$^2$ will heat an aluminum plate to the temperature range required for desensitization (230° C.) only up to a depth of about 40 μm; beyond that depth, the temperature drops below the threshold temperature very quickly, reaching a low temperature of about 20° C. at a depth of about 230 μm. In contrast, as shown in FIG. 5, plot 502, an electron beam having a voltage (energy) of 480 keV and a current density of 350 A/cm$^2$ will heat the metal to a temperature above 230° C. to a much greater depth of about 200 μm, with the result that desensitization will also occur up to a depth of about 200 μm within the metal. Although the temperature of the metal heated by the higher power electron beam drops more slowly than does the metal heated by the lower power beam, in both cases, as shown in plot 502, the metal temperature produced by that higher power beam drops to 20° C. at a depth in the metal of about 700 μm.

Thus, in accordance with the present invention, the treatment temperature, the duration for which the treatment temperature is maintained, and the depth of the treatment layer can be controlled across the entire range of conditions needed for desensitization (i.e., temperature of 230 to 345° C. and treatment depth of 10 to 200 μm) by varying the voltage, current, pulse length, repetition rate and/or number of pulses of the applied electron beam.

Figure 6:
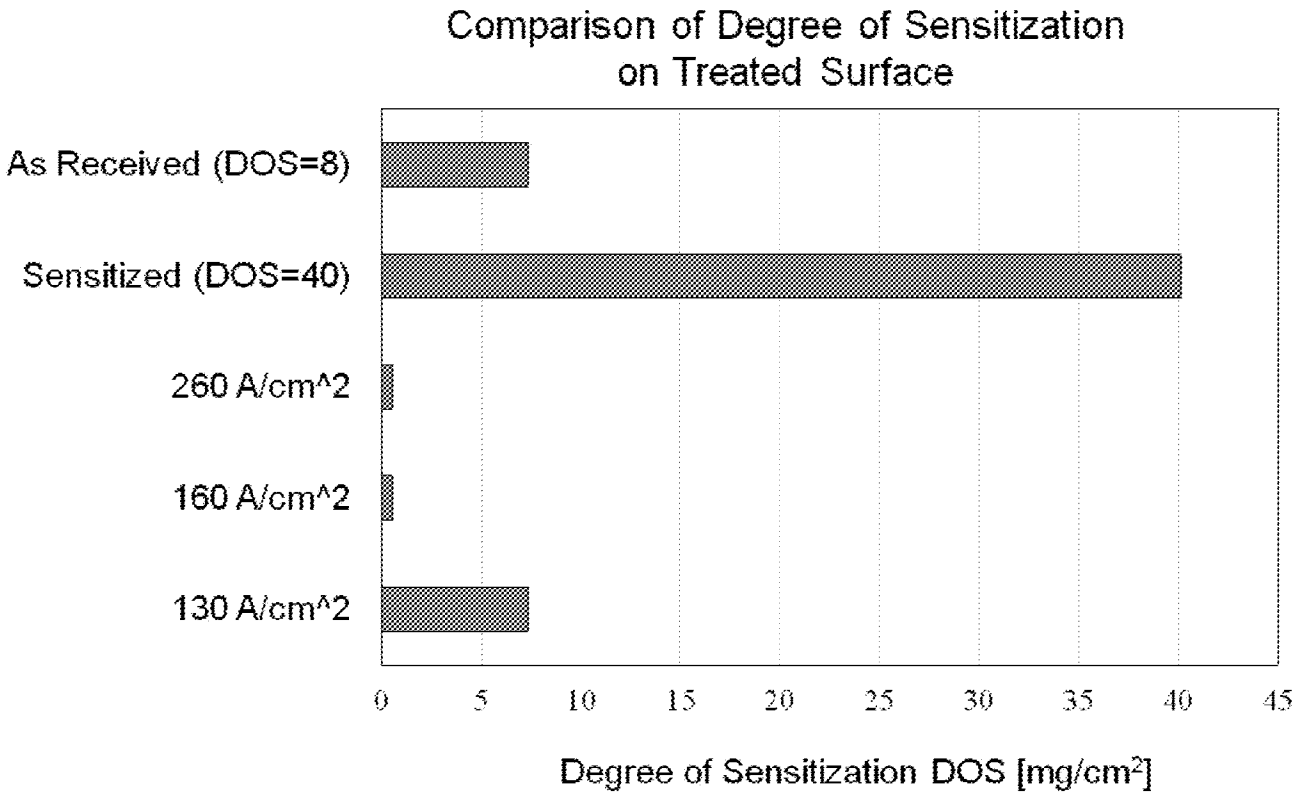
FIG. 6 contains a plot illustrating the DOS levels on the surface of a exemplary 5000 aluminum alloy in the original condition, after severe sensitization, and after desensitization in accordance with the present invention by pulsed electron beams having a current density of 130 A/cm$^2$, 160 A/cm$^2$, and 260 A/cm$^2$.

The plot in FIG. 6 illustrates that desensitization using a pulsed electron beam in accordance with the present invention not only removes the existing sensitization but can even place the metal in a better condition, with even less sensitization, than in the "as-received" state. To test the efficacy of the electron beam desensitization treatment method in accordance with the present invention, aluminum alloy samples were subjected to heat treatment to sensitize the samples and then were exposed to three different electron beams having different current densities. The DOS of the "as-received" sample, the sensitized sample, and treated samples was measured directly at the exposed surface.

The as-received condition of the material, which is the condition of the material as it is manufactured, typically is already partially sensitized with a DOS of 15 or lower. As shown in the plot in FIG. 6, in the present experiments, the as-received sample had a DOS of approximately 8. A typical laboratory heat treatment for evaluating the susceptibility of an alloy to sensitization is to heat the material at 100° C. for some period of time. In the present case the as-received sample was heated for 12.5 days, resulting in a DOS of 40, which is a high level that typically would result in severely degraded stress corrosion cracking and corrosion fatigue behavior.

The sensitized samples were treated with electron beams having a current density of 130 A/cm$^2$, 160 A/cm$^2$, and 260 A/cm$^2$. As can be seen from the plot in FIG. 6, in all cases, treatment of the sensitized samples with such electron beams in accordance with the present invention resulted in a significant reduction in the DOS in the sensitized sample. In the case of treatment by the 130 A/cm$^2$ beam, the DOS was reduced nearly to the "as-received" state, while in the case of treatment by the higher energy 160 A/cm$^2$ and 260 A/cm$^2$ beams, the samples were brought to a "better than new" state having a DOS of nearly zero.

Thus, the plots in FIG. 6 show that by using the method of electron beam desensitization treatment in accordance with the present invention, it is possible to reduce the DOS at the surface from 40 down to level comparable to the as-received material with a low current treatment, and to DOS of essentially zero with higher levels of current.

Figure 7:
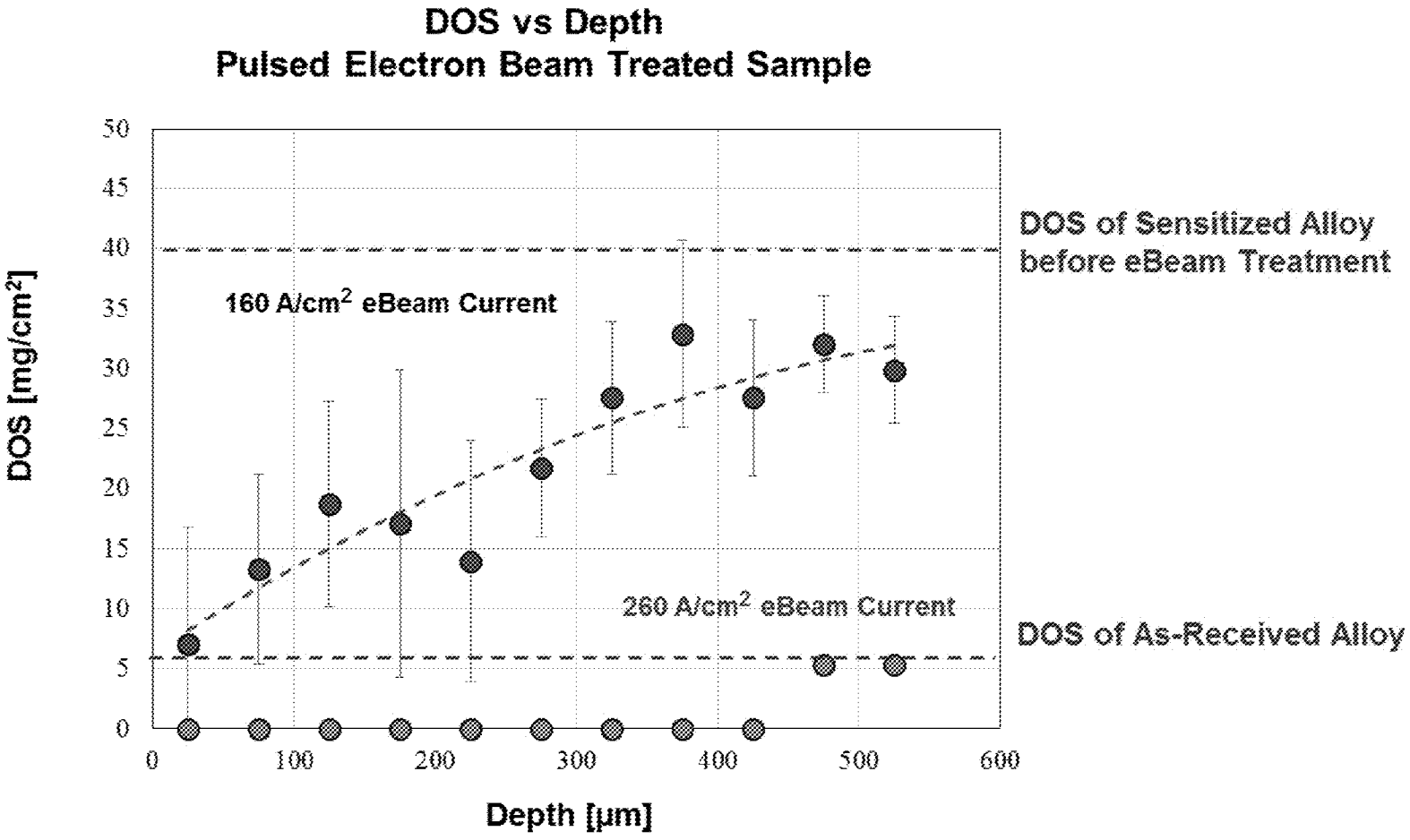
FIG. 7 contains a plot illustrating the degree of sensitization (DOS) at various depths in an aluminum sample and after electron beam desensitization at two current levels in accordance with the present invention.

The plots in FIG. 7 further illustrate the depth into the sample, below the surface, to which the desensitization effect occurs. If the electron beam current is too low, even though there may be a surface effect (for example, for the 130 A/cm$^2$ treatment illustrated in FIG. 6), the treatment does not extend below the surface. In contrast, if the current is very high, for example 260 A/cm$^2$, as can be seen in the plot in FIG. 7, the DOS is reduced to essentially zero at the surface and is very low (less than 5) even at a very deep depth within the sample, in this case up to 0.5 mm below the surface. For intermediate current levels, as can be seen for the plot of desensitization by a 160 A/cm$^2$ electron beam, the reduction in DOS is graded with depth in the sample, being reduced to essentially zero at the surface and increasing—but still remaining below the sensitized DOS level—below the surface.

Figure 8:
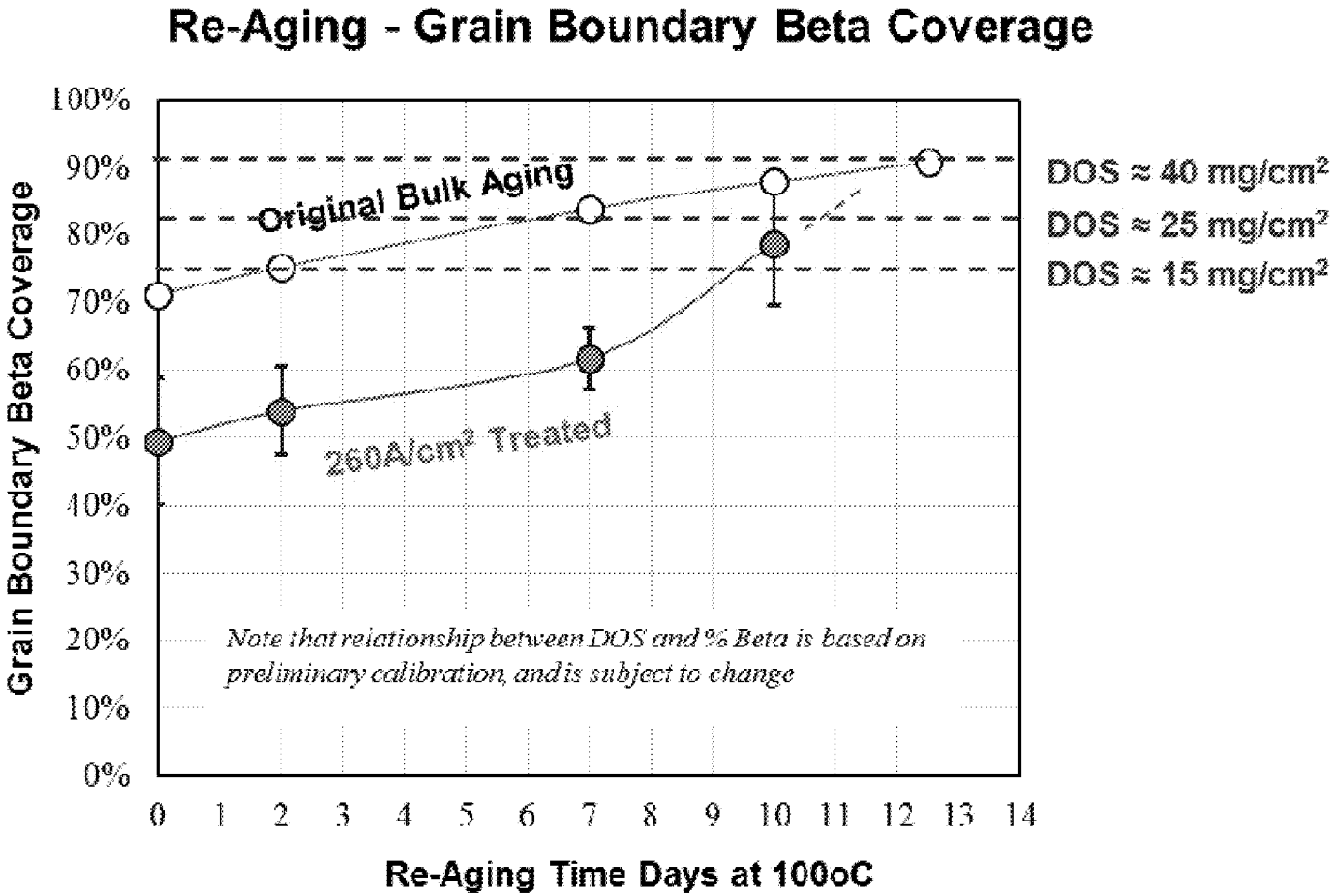
FIG. 8 contains plots comparing the typical amount of beta phase present on the grain boundaries in an untreated alloy as it is aged, and a pulsed electron beam treated alloy as it is re-aged after treatment.

FIG. 8 shows that it takes a longer time for a sample that has been desensitized with the e beam treatment at 260 A/cm$^2$ to "resensitize" to a given level, for example DOS of 15, than an original "as received" sample. FIG. 8 gives grain boundary beta phase coverage versus heat treatment time for the initial as-received condition, and a previously sensitized then electron beam treated condition. This illustrates a very large reduction of the amount of beta phase on the grain boundaries in the electron beam treated specimen, even considerably less than the original as-received material. The horizontal lines mark reference values relevant for ship service, as explained in more detail below with reference to FIG. 9. Note that it takes 2 days for the original as received sample to reach a DOS of 15, whereas it takes over 10 days to reach a DOS of 15 for a sample that has been treated at 260 A/cm$^2$.

Figure 9:
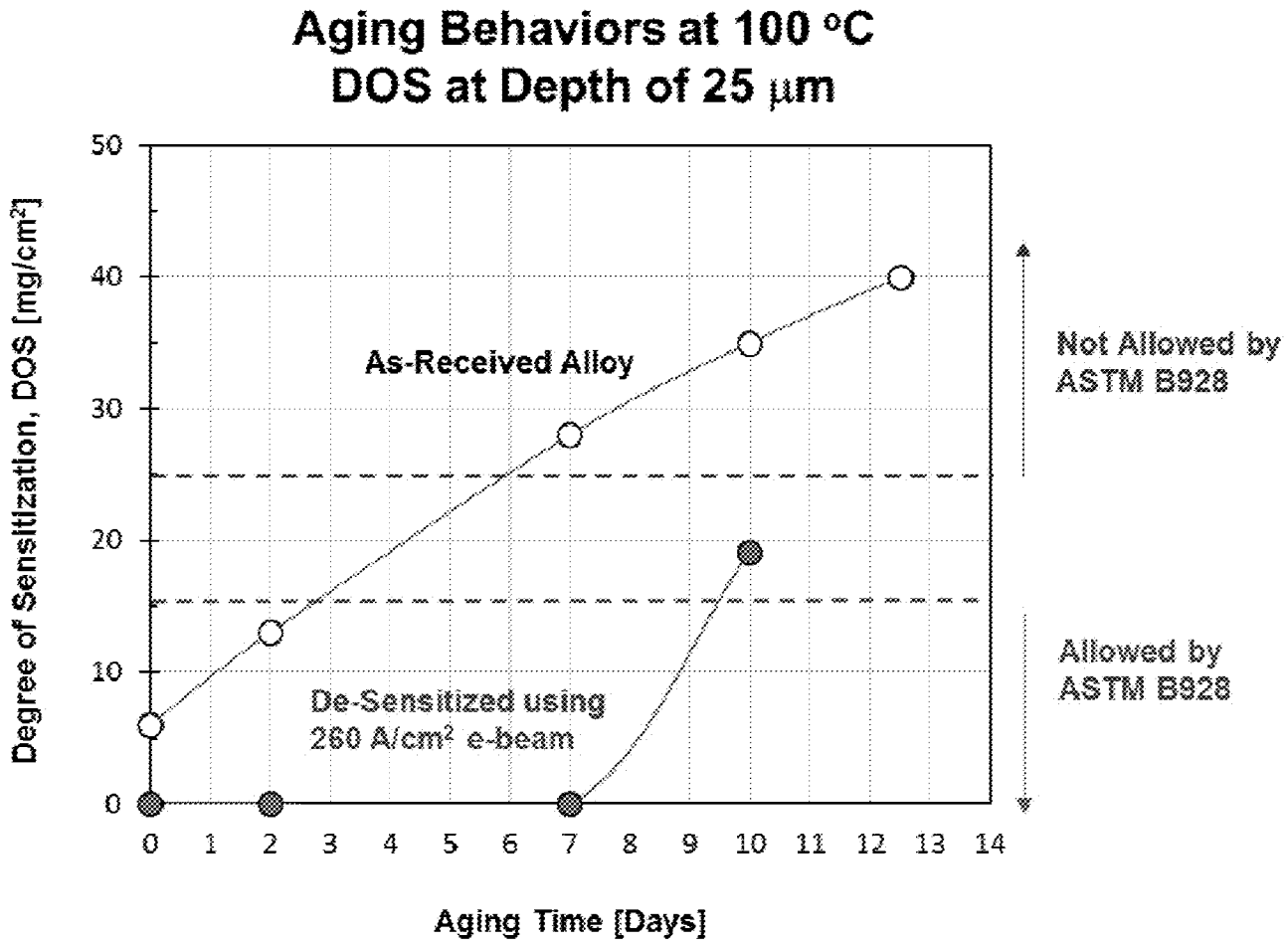
FIG. 9 contains a plot illustrating how electron beam desensitization of aluminum in accordance with the present invention affects the rate of its resensitization compared to the initial sensitization of the untreated alloy

FIG. 9 shows the same data as in FIG. 8 but in terms of the DOS, rather than the beta phase coverage. The horizontal lines mark reference values relevant for ship service according to ASTM B928 standard, which allows alloy with DOS below 15 to be used for ship construction, but recommends against use if DOS is more than 25. The DOS of 40 is the condition of the sensitized material used in this study, and is a high DOS that will exhibit degraded corrosion resistance. The as-received original material, with an initial DOS of about 8, reaches a DOS of 15 within 2-3 days at 100° C., and a DOS of 25 at about 6 days. In contrast, the material that has been desensitized by electron beam treatment in accordance with the present invention does not reach a DOS of 15 until 9-10 days of aging, and does not read a DOS of 25 until at least 11 days. Thus, the electron beam desensitization in accordance with the present invention has considerably extended the usable life of the alloy, from a factor of 5 at the DOS level of 15, to nearly a factor of 2 at the DOS level of 25.

EXAMPLE

These and other aspects of the invention will now be described in the context of the following Example. It will readily be appreciated by one skilled in the art that the following description is merely exemplary, and that 5000 series aluminum and/or other aluminum alloys may be desensitized in accordance with the method of the present invention through the application of electron beams having other voltage, current, and/or pulse parameters thereto.

In an exemplary case, samples of the aluminum-magnesium alloy 5456-H116 Alcoa Aluminum (Lot #357543) meeting the Navy standards for shipboard use were procured. The samples as delivered exhibited some degree of sensitization which is a normal characteristic of such metal alloys resulting from the natural migration of the dissolved magnesium to the grain boundaries. The samples were subsequently aged by heating the samples to 100° C. for 12-and-a-half days, using standard heating techniques accepted in the industry to produce a high degree of sensitization in the samples, as confirmed by standard metallographic techniques.

The samples were then exposed to 100 electron beam pulses produced by the NRL Electra repetitive pulsed electron beam facility. See J. D. Sethian, M. C. Myers, J. I. Giuliani, Jr., R. H. Lehmberg, P. C. Kepple, S. P. Obenschain, F. Hegeler, M. Friedman, M. F. Wolford, R. V. Smilgys, S. B. Swanekamp, D. Weidenheimer, D. Giorgi, D. R. Welch, D. V. Rose, and S. Searles, "Electron beam pumped krypton fluoride lasers for fusion energy," *Proc. IEEE,* 92, (2004) 1043-1056, the entirety of which is incorporated by reference into the present disclosure, for a description of this system. In this exemplary application of the method of the present invention, each electron beam pulse had a voltage of 500 kV, a current density ranging from 160 to 260 A/cm$^2$, a beam diameter of 3.6 cm, a pulse length of 100 nsec (flat top), a repetition rate of 5 pulses per second, and a total number of 100 pulses. However, any one or more of these parameters can be varied significantly as needed to achieve the desired DOS, with typical ranges being electron beam energy of 100 to 650 kV, current density of 100 to 400 A/cm$^2$, and pulse length of 70-140 nsec. The cathode (electron beam emitter) used in this Example was a disk of graphite, though it will be well appreciated that other emitters may also be used, such as an array of carbon fibers pyrolized to a carbon base, a velvet fiber cathode, or one made of a ceramic honeycomb over a fiber array emitter.

In this Example, the sample itself served as the electrical anode. In other cases, a thin metal (titanium, stainless steel, or aluminum) foil may be used as the anode, and in such cases, the electrons pass through the foil before impinging on the sample; such an approach may have advantages in the final application, as it prevents having to maintain a vacuum on the surface of the aluminum to be treated.

After the samples were aged, the level of their sensitization was assessed. Since the desensitization does not occur through the entire thickness of the specimens, standard techniques such as the ASTM G67 Nitric Acid Mass Loss Test are not applicable. Instead an alternative method was developed. In this alternative assessment method, the samples were subjected to a metallographic etching procedure and then examined with optical metallography to determine the amount of beta phase present on the grain boundaries. The etching is based on a general technique studied initially at the University of Virginia (see J. Buczynski, "Electrochemical analysis of etchants used to detect sensitization in marine-grade 5xxx aluminum-magnesium alloys," M.S. Thesis, University of Virginia (2012)) but modified specifically for this project. The specimens were immersed for 60 minutes in ammonium persulfate at 0.2 M concentration with pH adjusted to 1.2 using sulfuric acid in a temperature controlled bath at 35° C. The etchant selectively dissolved the alloy phase responsible for sensitization, and the relative level of sensitization is apparent by the continuity and thickness of etched areas in the sample grain boundary microstructure.

Figure 10A:
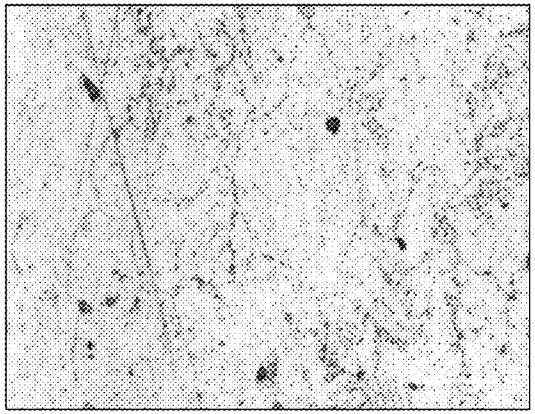
FIGS. 10A-10C are optical metallographic images depicting a 5000 aluminum sample as received, after aging and resulting sensitization, and after desensitization by exposure to an electron beam in accordance with the present invention.
Figure 10B:
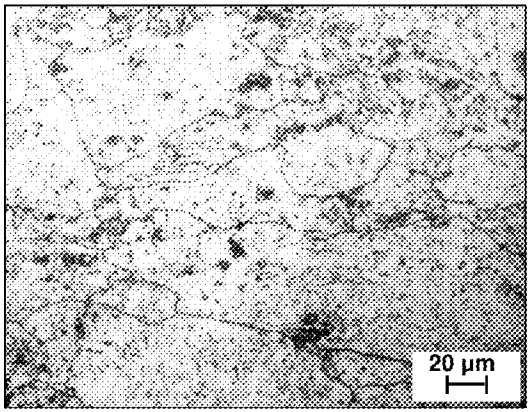
Figure 10C:
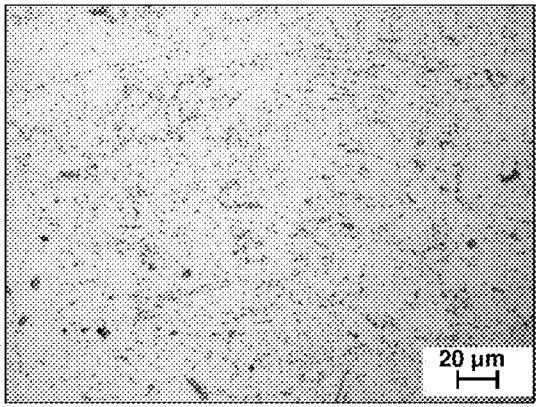

FIGS. 10A-10C shows a series of metallographs of samples of the same alloy. The samples were taken from the same plate (1) as received (FIG. 10A), (2) after it was aged (sensitized) in the laboratory (FIG. 10B), and (3) after the aged sample was treated with the pulsed electron beam (FIG. 10C). As can be seen in FIGS. 10A and 10C, desensitized aluminum is characterized by thin discontinuous grain boundaries (appearing as faint, irregular lines), whereas the sensitized aluminum shown in FIG. 10B exhibits wide continuous boundaries. Moreover, as can be seen in FIG. 10C, the sample that has been desensitized by electron beam treatment in accordance with the present invention appears to have even fewer sensitized boundaries than the original.

Figure 11A:
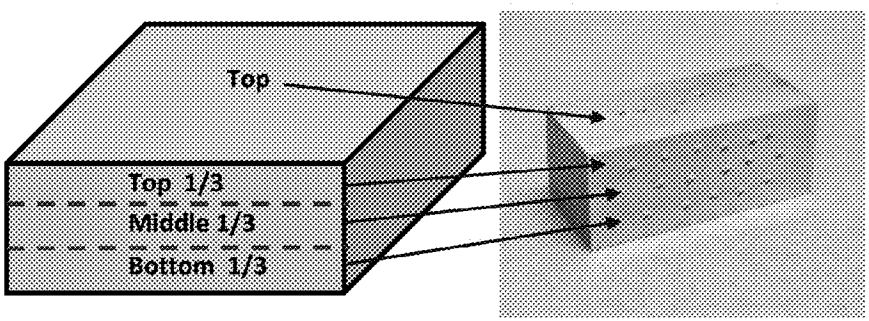
FIGS. 11A-11C illustrate aspects of Rockwell hardness testing on a sensitized 5000 aluminum sample and on 5000 aluminum samples that have been desensitized by exposure to an electron beam in accordance with the present invention.
Figure 11B:
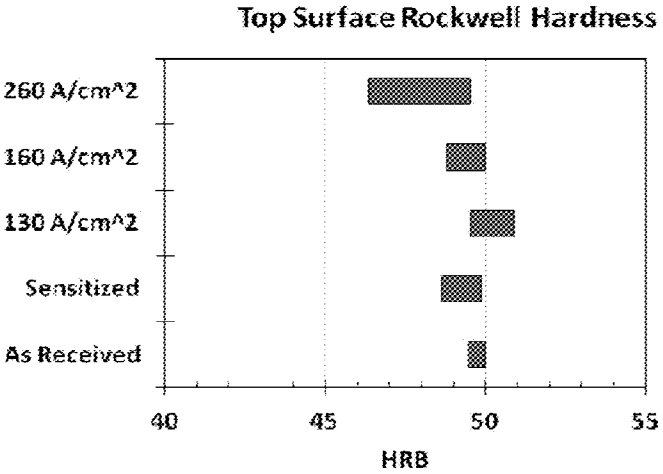
Figure 11C:
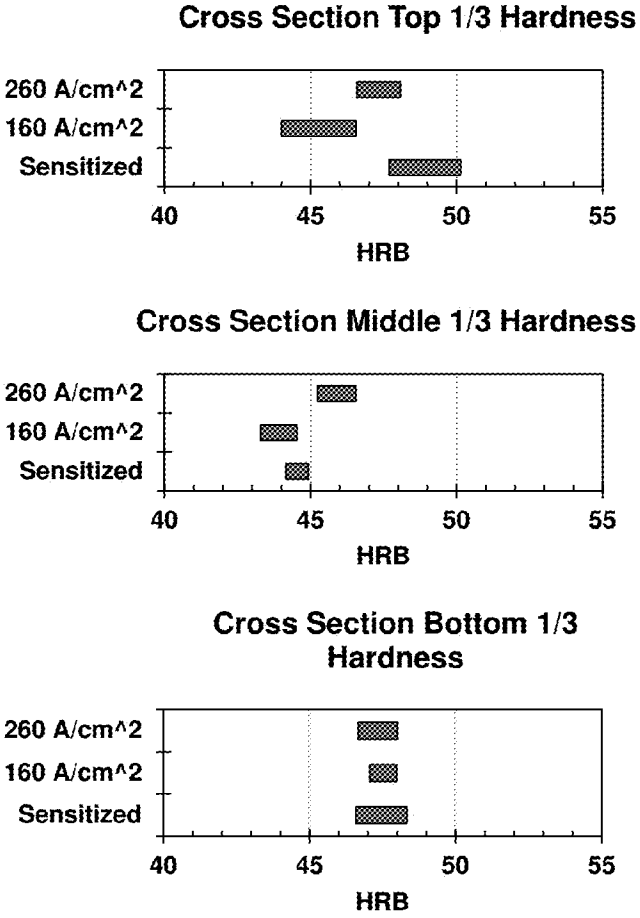
Figure 12:
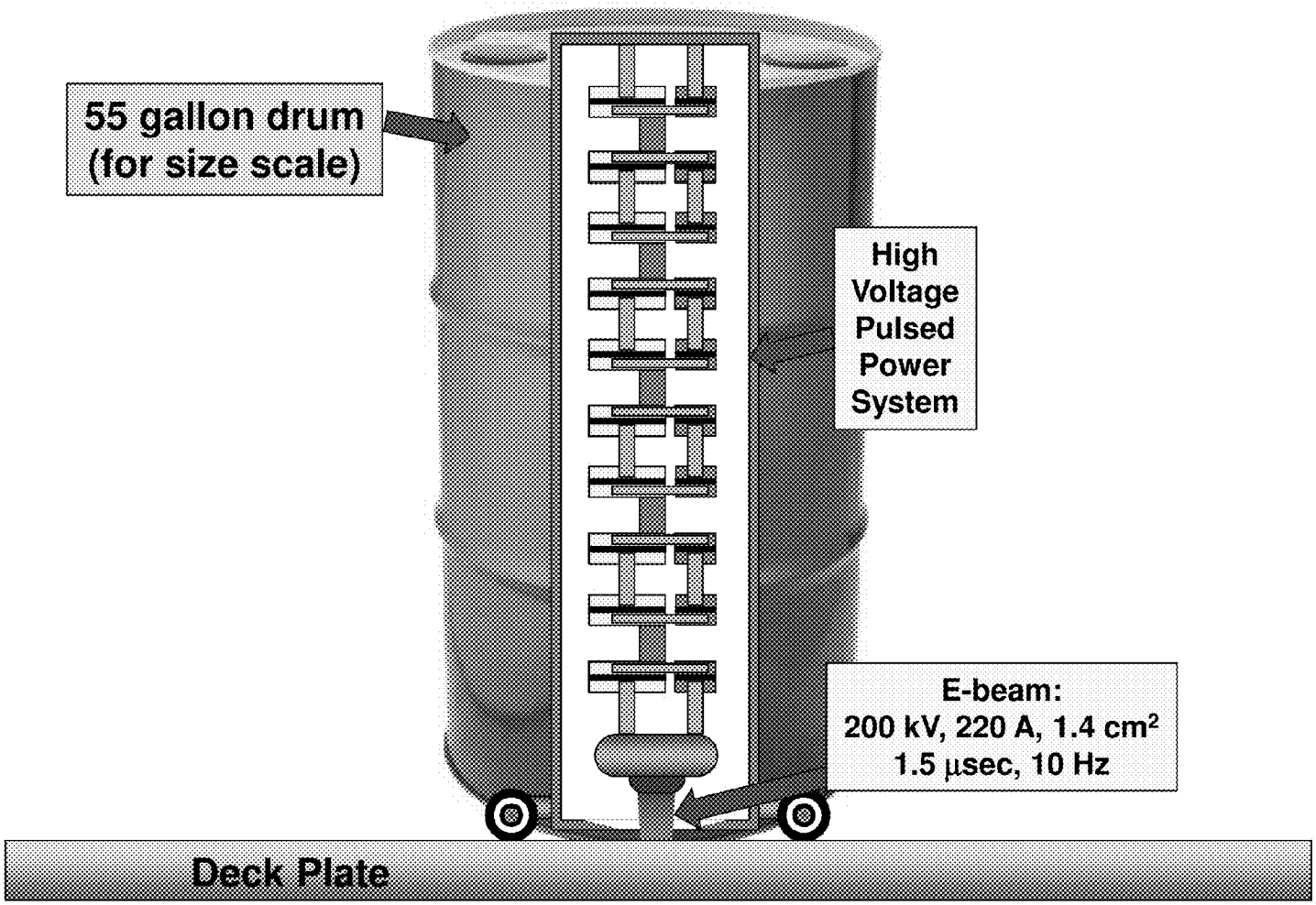
FIG. 12 is a block diagram illustrating aspects of an exemplary embodiment of a compact, portable apparatus that can be used for electron beam desensitization of aluminum in accordance with the present invention.

Electron beam desensitization of aluminum in accordance with the present invention does not significantly affect the strength of the bulk material. FIGS. 11B and 11C illustrate the results of Rockwell Hardness B scale measurements for aluminum alloy samples at the top surface (FIG. 11B) and the top, middle, and bottom cross-sections (FIG. 11C) where the positions of these cross section as shown in FIG. 11A, As can be seen from the plot in FIG. 11B, the Rockwell Hardness show that the hardness on the top surface is about the same for the as-received and sensitized samples, and remains the same after electron beam treatment at low and moderate current densities of 130 A/cm$^2$ and 160 A/cm$^2$, respectively. Although the top surface exhibits some softening after treatment by a higher current density (260 A/cm$^2$) electron beam, its hardness still remains within 10% of the unsoftened condition.

Similarly, the plots in FIG. 11C show the hardness measured in the top, middle, and bottom cross-sections of a sensitized and a treated sample. As can be seen in plots in FIG. 11C, while the top cross-section of a sample treated by electron beams having current densities of 160 A/cm$^2$ and 260 A/cm$^2$ shows softening of up to 10%, the middle cross-section shows that any change in Rockwell Hardness for the treated samples is within 1 or 2 HRB of the sensitized sample, while the bottom cross-section shows no change in Rockwell Hardness after treatment by either electron beam.

Thus, the Rockwell Hardness measurements show that while there may be a small softening effect at the surface and the top ⅓ cross-section for the highest electron beam exposures, such softening is not of a magnitude that would compromise the suitability of the material for its intended structural purpose. These results support the claim that the e-beam desenstizes the surface only, without affecting the strength of the bulk material.

Advantages and New Features:

As noted above, the 5000 series aluminum alloy which can be desensitized using the pulsed electron beam treatment of the present invention is a key component of maritime vessels used in both civilian and military applications, and electron beam desensitization of such alloys in accordance with the present invention has significant advantages over conventional desensitization methods currently being used.

Because the pulsed electron beam treatment of the present invention heats only a shallow layer having a thickness of 10 to 200 microns at the surface of the metal, the bulk of the material remains relatively cool. For example, an electron beam having energy of 100 kV to 600 kV deposits its energy in, and hence heats only, a very shallow layer having a thickness of 50-100 microns at the surface. Heating the aluminum at this depth is sufficient to reduce the detrimental effects of sensitization, as corrosion caused by sensitization is a surface phenomenon. This can provide a particular advantage when desensitization of aluminum that has already been incorporated into a ship is desired. Typical 5000 series aluminum shipboard structures are on the order of 5-8 mm thick, but they can be as much as 10 mm, so even if the temperature of the backside of the structure does increase, it should be readily straightforward to deal with this additional heat using straightforward thermal management techniques, possibly as simple as circulating fans or water cooled contact plates.

In addition, electron beam desensitization in accordance with the present invention provides a non-contact method for applying heat and desensitizing a sensitized alloy, with the electron beam source being separated from the aluminum by a distance of 1-5 mm, depending on the conditions and the particular configuration of the beam apparatus. In addition, although the electrons carry energy, they carry virtually no momentum, so there is no mechanical loading of the structure.

Moreover, the electron beam desensitization method in accordance with the present invention is not a chemical process and does not apply a new material or coating to the alloy surface. Instead, the electron beam simply reverts the grain structure of the material to its original state. Thus there should be no need for retesting and certification of the alloy, as would be the case if the surface chemistry was altered or a coating was applied.

The electron beam desensitization method of the present invention can be used either to remediate in-service material that has become sensitized, or to treat new material to reduce the initial degree of sensitization.

It is also believed that an appropriate electron beam system could be made small enough to be transportable. An exemplary embodiment of such a portable apparatus is illustrated in FIG. 11, where the apparatus is comparable in size to a 55 gallon drum common on board ships, and is on a wheeled platform to easily move to desired locations on board the vessel. The electron beam source can be rigidly attached to the pulsed power system, or, in some embodiments, can be located at the end of a flexible electrical transmission line to allow easier access to parts of the superstructure. In other embodiments, the apparatus can be mounted on a vertical structure that can be varied in height, e.g., using a forklift or scissors jack-like mechanism, so that it can treat non-horizontal shipboard features such as superstructure plating.

Thus it is anticipated that this invention could perform shipboard reversal of sensitization in situ, before the onset of cracks. As corrosion repair is a significant cost for the Navy, this could meaningfully lower total ownership costs for the fleet.

Although particular embodiments, aspects, and features have been described and illustrated, it should be noted that the invention described herein is not limited to only those embodiments, aspects, and features, and it should be readily appreciated that modifications may be made by persons skilled in the art. The present application contemplates any and all modifications within the spirit and scope of the underlying invention described and claimed herein, and all such embodiments are within the scope and spirit of the present disclosure.

What is claimed is:

1. A method for controllably desensitizing a metal alloy sample, comprising:

exposing a specific desired location on a surface of the sample to a controlled pulsed electron beam having a voltage greater than 100 kV to about 650 kV;

wherein the electron beam is controllably directed to the specific desired location without exposing other areas on the sample to the electron beam; and wherein the electron beam heats a shallow surface layer of the metal alloy having a desired depth at the specific desired location on the surface of the sample to a controlled temperature between a solvus temperature and an annealing temperature of the metal alloy without heating a bulk of the sample to controllably reduce a degree of sensitization of the metal alloy sample at the specific desired location, an extent of a reduction in the degree of sensitization being controllable by varying at least one of a voltage, a current density, a pulse duration, and a pulse frequency of the electron beam.

2. The method according to claim 1, wherein a depth from the surface of the sample at which the sample's sensitization is reduced is controllable by varying at least one of a voltage, a current density, a pulse duration, a pulse frequency and a number of pulses of the electron beam.

3. The method according to claim 1, wherein the electron beam is configured to heat a layer having a depth of between 10 and 200 microns at the surface of the metal alloy.

4. The method according to claim 1, wherein the electron beam is configured to reduce the degree of sensitization in a layer having a depth of about 10-200 μm at the surface of the metal alloy sample.

5. The method according to claim 1, wherein the electron beam produces a controllably graded reduction in the degree of sensitization in the metal alloy sample, the reduction in the degree of sensitization being greatest at the surface of the sample and decreasing at depths in the sample away from the surface, a profile of the graded reduction in desensitization being controllable by controlling at least one of a voltage a current density, a pulse duration, a pulse frequency of the electron beam, and a number of pulses of the electron beam.

6. The method according to claim 1, wherein the electron beam is configured to produce a heated layer having a depth of 10 to 200 μm at the surface of the metal alloy sample.

7. The method according to claim 1, wherein the electron beam is configured to produce a heated layer having a temperature of 230 to 345° C. at the surface of the metal alloy sample.

8. The method according to claim 1, wherein the electron beam is configured to have a current density of 10 $A/cm^2$ to 400 $A/cm^2$.

9. The method according to claim 1, wherein the electron beam has a pulse duration of 70 nsec to 2000 nsec.

10. The method according to claim 1, wherein the electron beam has a pulse frequency of 0.1 Hz to 5 Hz.

11. The method according to claim 1, wherein the number of electron beam pulses varies between 1 and 100.

12. The method according to claim 1, wherein the metal alloy is an aluminum-magnesium alloy, and wherein the electron beam is configured to produce a heated layer having a temperature of between about 230° C. and about 345° C. at the surface of the sample.

13. The method according to claim 10, wherein the metal alloy is a 5000-series aluminum alloy.

14. The method according to claim 1, wherein the electron beam is fired for a total of 100 pulses at a pulse repetition rate of 5 pulses per second.

15. A method for controllably desensitizing a metal alloy sample, comprising:

exposing a specific desired location on a surface of a metal alloy sample to a controlled pulsed electron beam having a voltage greater than 100 kV to about 650 kV;

wherein the electron beam travels through an ambient atmosphere to the sample and is controllably directed to the specific desired location without exposing other areas on the sample to the electron beam;

wherein the electron beam heats a shallow surface layer of the sample having a desired depth at the specific desired location on the surface of the sample to a controlled temperature between a solvus temperature and an annealing temperature of the metal alloy without heating a bulk of the sample to controllably reduce a degree of sensitization of the sample at the specific desired location, an extent of a reduction in the degree of sensitization being controllable by varying at least one of a voltage, a current density, a pulse duration, and a pulse frequency of the electron beam.

16. A method for controllably desensitizing a deckplate on a marine vessel, comprising:

exposing a specific desired location on a surface of a deckplate to a controlled pulsed electron beam having a voltage greater than 100 kV to about 650 kV;

wherein the electron beam is applied to the deckplate in situ on the vessel and is controllably directed to the specific desired location on the surface without exposing other areas on the deckplate to the electron beam; and wherein the electron beam heats a shallow surface layer of the deckplate having a desired depth at the specific desired location on the surface of the deckplate to a controlled temperature between a solvus temperature and an annealing temperature of the metal alloy without heating a bulk of the deckplate to controllably reduce a degree of sensitization of the deckplate at the specific desired location, an extent of a reduction in the degree of sensitization being controllable by varying at least one of a voltage, a current density, a pulse duration, and a pulse frequency of the electron beam.

* * * * *